US012638250B2

(12) United States Patent
Kisi et al.

(10) Patent No.: US 12,638,250 B2
(45) Date of Patent: May 26, 2026

(54) ENERGY STORAGE

(71) Applicant: MGA Thermal Pty Ltd, Tomago (AU)

(72) Inventors: Erich Kisi, Tomago (AU); David Tanner, Tomago (AU)

(73) Assignee: MGA THERMAL PTY LTD, Tomago (AU)

( * ) Notice: Subject to any disclaimer, the term of this patent is extended or adjusted under 35 U.S.C. 154(b) by 0 days.

(21) Appl. No.: 18/722,175

(22) PCT Filed: Nov. 21, 2022

(86) PCT No.: PCT/AU2022/051391
§ 371 (c)(1),
(2) Date: Jun. 20, 2024

(87) PCT Pub. No.: WO2023/115098
PCT Pub. Date: Jun. 29, 2023

(65) Prior Publication Data

US 2025/0044041 A1 Feb. 6, 2025

(30) Foreign Application Priority Data

Dec. 21, 2021 (AU) ..... 2021904176

(51) Int. Cl.
*F28D 20/02* (2006.01)
*F28D 20/00* (2006.01)
*F28F 21/08* (2006.01)

(52) U.S. Cl.
CPC ..... *F28D 20/021* (2013.01); *F28D 20/0056* (2013.01); *F28F 21/081* (2013.01); *F28D 2020/0013* (2013.01)

(58) Field of Classification Search
CPC ..... F28D 20/021; F28D 20/0056; F28D 2020/0013; F28D 20/025; F28D 20/028;
(Continued)

(56) References Cited

U.S. PATENT DOCUMENTS 10,858,960 B2 12/2020 Zwinkels
2011/0083459 A1* 4/2011 Salyer ..... F24H 3/002 62/476

(Continued)

FOREIGN PATENT DOCUMENTS

EP 3746648 A1 * 12/2020 ..... F02C 6/16
WO 2014063191 A1 5/2014

(Continued)

OTHER PUBLICATIONS

International Search Report and Written Opinion for application No. PCT/AU2022/051391, Jan. 17, 2023, 10 pages.
Copus, Mark, et al., "On-sun testing of Miscibility Gap Alloy thermal storage," Solar Energy, Jan. 2019, pp. 657-664, 177.
Notice of Acceptance for related Australian Application No. 2022275394, Feb. 23, 2023, 3 pages.

(Continued)

*Primary Examiner* — Harry E Arant
(74) *Attorney, Agent, or Firm* — Carter, DeLuca & Farrell LLP

(57) ABSTRACT

An energy storage device for storing thermal energy is disclosed. The energy storage device comprises at least one heating device; a thermal storage body comprising at least one thermal storage block formed from a miscibility gap alloy; thermal insulation surrounding said thermal storage body; and at least one substantially impermeable shell surrounding the thermal storage body and/or the thermal insulation. The device is arranged such that heat can be charged or discharged from said thermal storage body by thermal transfer between said at least one heat transfer channel and at least one thermal storage block. The invention also relates to a method and a system for storing thermal energy in said at least one thermal storage block formed from a miscibility gap alloy.

22 Claims, 8 Drawing Sheets

(58) Field of Classification Search
CPC ..... F28D 2020/0026; F28D 2020/0047; F28D 20/00; F28F 21/081; F01D 25/00
See application file for complete search history.

(56) References Cited

U.S. PATENT DOCUMENTS

| | | | | |
|---|---|---|---|---|
| 2012/0319410 | A1 | 12/2012 | Ambrosek et al. | |
| 2016/0097603 | A1 | 4/2016 | Zwinkels | |
| 2022/0120514 | A1* | 4/2022 | Spero | F28D 20/021 |
| 2022/0307386 | A1* | 9/2022 | Savic | F28D 20/0056 |

FOREIGN PATENT DOCUMENTS

| | | | | |
|---|---|---|---|---|
| WO | WO-2019149623 | A1 * | 8/2019 | F02C 6/16 |
| WO | 2021108846 | A1 | 6/2021 | |

OTHER PUBLICATIONS

Notice of grant for patent for related Australian Application No. 2022275394, Jun. 22, 2023, 1 page.

Examination Report for related Australian Application No. 2022275394, Jan. 18, 2023, 6 pages.

Response to Examination Report for related Australian Application No. 2022275394, Jan. 30, 2023, 19 pages.

Response to Examination Report for related Australian Application No. 2022275394, Feb. 14, 2023, 4 pages.

Granted Patent for Australian Application No. 2022275394, Jun. 22, 2023, 48 pages.

Extended European Search Report for application No. 22908861.2, Nov. 7, 2025, 7 pages.

* cited by examiner

ENERGY STORAGE

CROSS REFERENCES TO RELATED APPLICATIONS

This application is a national phase filing under § 371 of International Application No. PCT/AU2022/051391 filed on Nov. 21, 2022, which claims the benefit of the earlier filing date of Australian provisional patent application 2021904176, filed on 21 Dec. 2021, the entirety of each such application is hereby incorporated by reference herein as if fully set forth herein.

FIELD OF THE INVENTION

The present invention relates to a device for the capture, storage and release of thermal energy as well as a method of capturing, storing and release of energy.

BACKGROUND TO THE INVENTION

Renewable energy sources such as wind and solar power are becoming increasingly important environmentally and economically. According to the WMO (World Meteorological Organization), the concentration of greenhouse gases in the atmosphere reached 400 ppm in 2015 and passed 413 ppm by 2020. A speedy transition is required to stabilise the concentration of greenhouse gases at a generally acknowledged critical threshold of 450 ppm. Delays in the implementation of renewable and carbon neutral energy sources narrow the window for action and also increase the cost of transforming the energy sector by an estimated $500 billion per year.

Unfortunately, most forms of renewable energy (with the exception of geothermal and hydroelectricity) suffer from intermittency of supply. For example, the diurnal cycle and weather conditions directly affect solar generation. Wind and wave sources are also intermittent and the energy depends on the prevailing environmental conditions.

In order to make renewable energy sources more attractive and to increase the availability of the electric energy generated from such sources, energy needs to be stored during times of surplus and released during times where demand would otherwise exceed supply.

Conventional energy storage technologies exist based upon well established chemical, electrochemical or mechanical means. Batteries are well known, for example, and the pumping of water up to reservoirs for subsequent hydroelectric generation is also a well established technical field. Unfortunately, many of these technologies have relatively low energy storage densities (low stored energy per unit volume) and the energy storage by chemical, electrochemical or mechanical means are all subject to energy losses in the storage-recovery cycle additional to those associated with eventual energy utilisation.

For thermal sources of energy, direct Thermal Energy Storage (TES) can be made extremely efficient, suffering only environmental losses through the insulation envelope. For example, sensible heat based concentrated solar thermal (CST) plants, which use thousands of tonnes of molten KNO3/NaNO3 salt for sensible heat storage, have a relatively high return thermal efficiency.

Recently, energy storage devices have been proposed which use solid storage materials in the form of stones or concrete, in order to store thermal energy. The stored thermal energy can be used in times of high demand to generate steam for heating or for driving a steam power plant, in order to convert the stored thermal energy back to electric energy.

One such form of solid energy storage material is that disclosed in (WO 2014/063191 A1) which utilises miscibility gap alloys as thermal storage materials.

These materials comprise a containment matrix within which are dispersed microparticles of a meltable material. At low temperatures, below the melting point of the meltable material, the whole is solid. At temperatures above the melting point of the alloy from which the microparticles are made, the microparticles are liquid. The material is highly efficient in terms of energy storage and release which take place via thermal transfer with the surface of the matrix.

The term "microparticles" can be used in an absolute or relative sense. For instance, in the absolute sense, microparticles can refer to particles which are of a size less than 100 μm in size, for example 10 μm or even 1 μm or smaller.

Alternatively, in the relative sense, microparticles can refer to particles which are at least two orders of magnitude (>100×) or more smaller than the overall storage block dimension into which the thermal storage material is formed.

This form of thermal storage is direct as sensible heat due to temperature rise or latent heat due to a phase change. Such phase change systems are potentially very useful as they exhibit very high energy storage density, much higher than competing technologies. Moreover, the phase change system can easily be tailored to the target application by altering its constituent materials to those with melting points in the desired temperature range, thus modifying its thermal storage and release characteristics.

In addition to a high energy density per unit volume, such materials also have a relatively short time requirement to recharge and discharge. and are relatively cost effective.

The application of efficient thermal energy storage systems to capture heat from renewable sources like solar or waste heat from existing industries can offer significant savings and reduction in the emission of greenhouse gases.

Approximately 50% of energy used for heating is consumed by residential space heating applications with the remainder being utilized by industry for low-temperature steam generation and process drying.

Further, if effective thermal storage solutions are developed, the range of applications is not limited to renewable energy sources. The technology can also be used for load shifting applications in conventional technologies, for example, through the conversion of fossil fuel power stations into storage and dispatch systems. Alternatively, thermal storage solutions can be implemented for recovering wasted energy from large-scale industrial processes and redispatching it during plant start-up.

Any discussion of the prior art throughout the specification should in no way be considered as an admission that such prior art is widely known or forms part of common general knowledge in the field.

It is an object of the present invention to overcome or ameliorate at least one of the disadvantages of the prior art, or to provide a useful alternative, preferably new materials that are suitable for use as high energy density high thermal conductivity thermal storage materials.

SUMMARY OF THE INVENTION

In a first aspect of the present invention, there is provided an energy storage device comprising:

at least one heating device;

a thermal storage body comprising at least one thermal storage block formed from a miscibility gap alloy, wherein said at least one thermal storage block is arranged such that at least one heat transfer channel adapted to receive heat transfer fluid flow and/or said at least one heating device is formed therein;

thermal insulation unit surrounding said thermal storage unit such that said thermal storage unit is substantially thermally insulated; and at least one substantially impermeable shell surrounding the thermal storage body and/or the thermal insulation such that the heat transfer fluid is substantially contained, wherein heat can be charged or discharged from said thermal storage body by thermal transfer between said at least one heat transfer channel and at least one thermal storage block.

Structure of Device

In some embodiments, the energy storage apparatus is a thermal energy storage apparatus. The apparatus of the present invention is configured to store thermal energy to overcome or ameliorate the disadvantages of known thermal energy storage solutions, including but not limited to those that utilise recirculating molten salts, conductive solid materials such as graphite and material with high dead-space volume such as granular material. These include long term degradation of the storage and discharge capacities through destructive expansion, crumbling or erosion of the solid storage material itself or vessels carrying the fluids, the natural discharge of the stored thermal energy, difficulty in maintenance of thermal contact with heat exchange infrastructure and its high set-up expense. Thermal energy storage utilising miscibility gap alloys by comparison have a higher energy density than sensible heat-only solutions due to the fact that it is also stores latent heat energy, while also displaying little hysteresis or long-term degradation in structural rigidity/performance upon repeated charging, storage and discharge of thermal energy.

In some embodiments of the present invention, the thermal storage body comprises one or more thermal storage blocks arranged to form at least one heat transfer channel inside of the thermal storage body. The heat transfer channels provide an exposed surface acting as an interface for transferring thermal energy between the heat transfer fluid or a heating device and the storage body by conduction, convection and/or radiation.

The person skilled in the art would appreciate that thermal transfer between a solid thermal storage body and a heat transfer fluid can be made by contact directly therebetween or through a heat exchanger apparatus. Accordingly, the at least one thermal storage block formed from a miscibility gap alloy (herein "MGA storage block") can be either directly exposed to the flow of heat transfer fluids, or be in contact with the conductive walls of a heat exchanger apparatus. The thermal storage body comprises a heat transfer channel having at least two openings such that forced flow of the heat transfer fluid therein can be facilitated by apparatuses such as pumps and/or blowers located outside of the energy storage device.

The MGA storage blocks can be of any shape, but will be described herein with reference to hexahedral storage blocks. Examples of hexahedral storage blocks are cubes or elongate square or rectangular prisms.

Preferably the thermal storage blocks are directly exposed to the heat transfer fluid by directly passing said fluid through the heat transfer channel. In this embodiment, thermal energy is passed by conduction and convection between the fluid and the MGA thermal storage blocks directly, without any conductive barrier such as a heat exchanger apparatus wall in between. The inventor found this configuration to be advantageous in light of the density and conductivity of the MGA material forming the heat storage blocks negating the benefits of heat exchanger piping, resulting in improved heat retention in storage and transfer during charge/discharge.

The person skilled in the art would appreciate that the thermal storage body can be, but is not necessarily required to be constructed from a single thermal storage block. Preferably, the thermal storage body is assembled from a plurality of thermal storage blocks with sufficient strength to support their own and the storage body's weight. While a unitary construction of the thermal storage body would allow for improved conduction and heat retention within the miscibility gap alloy forming the single thermal storage block, such a construction would pose difficulties in forming the heat transfer channels, and could result in inadequate heating and/or heat extraction during operation of the energy storage device. Benefits of constructing a thermal storage body from multiple thermal storage blocks include improved uniformity in heat charge/discharge across the internal cross section of storage body achievable by an increased number and ease of incorporating heating devices and heat transfer channels for fluids.

The thermal storage blocks can be formed to fulfil a variety of criteria if desired, for example, such as maximising contact area with a heat transfer flow, for modular storage and assembly or to facilitate transportation. or be sized to retain a predetermined amount of heat.

Preferably, the at least one thermal storage block is fabricated such that when fully constructed, the thermal storage body which it comprises, includes appropriate channels or recesses to accommodate fluid flow and heating devices. Where the thermal storage body is constructed from multiple thermal storage blocks formed from a miscibility gap alloy, the blocks may simply be stackable hexahedral blocks or in some embodiments they may be fabricated such that they provide structural support for the assembled thermal storage block, In one embodiment, the thermal storage blocks slot into each other via pre-fabricated slots. in this regard, the heat transfer channels may be fabricated in the thermal storage blocks for accommodating the heating device and/or heat transfer fluid flow or may be formed by particular arrangements of the thermal storage blocks, the channels formed therebetween.

When the thermal storage body is constructed from multiple thermal storage blocks, the thermal storage blocks are arranged such that their dimensional expansion under thermal load is taken into account in its structural support and rigidity. In this regard, permanent deformation of the thermal storage body caused by thermal expansion-related stresses and strains during heating and thermal storage can be prevented by incorporating at least one spacer between said multiple thermal storage blocks. Moreover, by preventing excessive straining of the thermal storage blocks under thermal expansion, thermal-related creep and associated issues can be also be alleviated, including a loss of structural strength, breakdown of the blocks and a build-up of internal pressure by the expansion of the blocks against each other (also known as thermal ratcheting).

A spacer in this regard is a solid, thermally resistant material that is adapted to abut against the outer surface of the each said multiple thermal storage blocks such that an interstitial space is created and maintained between an array thereof. In one example, the spacers are provided adjacent to each corner of a hexahedral MGA block comprising the thermal storage body such that interstitial space is provided adjacent to at least two sides thereof. This interstitial space provided between the MGA blocks can constitute the heat transfer channels for facilitating thermal transfer between the MGA blocks and the heating element and/or the heat transfer fluid. Preferably, the spacer is formed from metallic material such that is adapted to maintain structural rigidity under expansionary load of the MGA blocks in order to maintain said interstitial spaces and prevent deformation of said blocks.

The shape of the spacers in this regard are adapted based on several factors, including the shape of the thermal storage blocks, the desired volume of the interstitial spaces, and thus the heat transfer channels, as well as the thermal expansion coefficient of the material employed in the thermal storage block. In one embodiment, the spacer is formed of a metallic bar with a "T"-shaped cross-section, adapted to accommodate and abut both corners and a side of a hexahedral thermal storage block. In another embodiment, the spacer is an elongated cylindrical bar of differing lengths. In a further embodiment, both types of spacers are used in an alternating manner to secure MGA blocks in an array thereof, forming the thermal storage body.

To avoid energy loss to the external environment, the thermal storage body is surrounded by insulation material comprising the thermal insulation unit. The insulation material in the form of panels, blocks, mineral wools, foams and/or insulation blanks are suitably located on an outer surface of the thermal storage body to substantially insulate therein, and thus minimise thermal energy lost to the external environment. A person skilled in the art would appreciate the insulation needs for the thermal storage body and would be able to suitably design an insulation solution according to the required specifications.

Further to the above, there is also provided a substantially fluid-tight containment or shell structure to prevent expanded heated gases and/or heat transfer fluids from escaping the energy storage device. In this regard, at least one impermeable layer of material is provided on the outside of the thermal storage body to surround it and contain the heat transfer fluids therein. Preferably, this containment/shell structure is formed from metals, more preferably a steel alloy such as mild steel or stainless steel. A further preferable embodiment can also comprise an inner and outer shell with the insulative material provided therebetween. In such a structure, the inner shell provides substantial sealing of the thermal storage body and heat transfer fluids, while the outer shell provides improved thermal containment and structural rigidity by encapsulating the insulative material.

Use of MGA

As discussed above, the at least one thermal storage block comprising the thermal storage body is formed from a miscibility gap alloy (MGA). The term "miscibility gap" in the context of this alloy means that there is to some extent immiscibility between the components of the alloy, and at certain ratios and temperatures the alloy de-mixes from a miscible alloy to form distinct phases that co-exist in the microstructure of the thermal storage block. An alloy in this regard refers to a material comprising a thermodynamically stable mixture of at least two constituent materials selected from metallic, semi-metallic or non-metallic materials.

As discussed in PCT/AU2013/001227, it is known that high temperature thermal storage is efficiently achieved in a compact footprint using thermodynamically stable two phase mixtures in which the active phase that undergoes melting and solidification during charge-discharge cycle is present as discrete particles fully enclosed within a dense, continuous, thermally conductive matrix. The Inventor has found that by charging thermal energy and maintaining a certain temperature within a block formed of MGAs, miscibility gaps in the phase diagrams of the alloys are exploited to store said energy in the form of latent heat of transformation and fusion, in addition to the sensible heat initially charged thereinto.

Further to the above, in a preferable form, the thermal storage block this MGA comprises:

(i) a dense continuous thermally conductive matrix of a first component;

(ii) particles of a second component dispersed throughout the matrix of the first component;

wherein the first and second components are thermally stable wholly or partly immiscible in solid form and wherein the first component melts at a higher temperature than the second component; and wherein the first component contains and confines the second component at all times, including when the second component is in a molten or flowable state; and wherein the first and second components can be independently metallic or non-metallic; and wherein the particles of the second component are microparticles.

In this preferable embodiment, the MGA have an "inverse microstructure" where the low melting point high energy density phase is trapped as small particles within a high thermal conductivity solid matrix that can deliver heat rapidly over large distances. This is as opposed to the naturally forming microstructure of miscibility gap alloys where the high melting point phase is trapped within a matrix of low melting point material. As discussed in PCT/AU2013/001227, this preferable allow system overcomes the conductivity, energy density, corrosion and instability problems of conventional phase change thermal storage systems.

The first component may be formed from a single compound or element, or it may be a mixture of compounds or elements. Likewise, the second component, which is fusible, may be a single compound or element or it may be a mixture of compounds or elements. In the simplest case, where the first and second components are elemental or a single compound, the overall system will be a binary system having two discrete phases. In cases where one component is an alloy of two elements or compounds, and the other component is an element or single compound, the system will be a ternary system having two discrete phases. Ternary, quaternary and higher systems are possible depending upon the constituents of the system, that is if the first component has n compounds or elements and the second component has m compounds or elements, the phase diagram will be an n+m system. The critical factor in the selection of the combination of first component and second component is the presence of a miscibility gap in the relevant phase diagram and the temperature or range of temperatures at which the "active" fusable second component phase changes with the production/consumption of latent energy.

In one embodiment, the first component is metallic and the second component is metallic. Alternatively, the first component is metallic and the second component is non-metallic, or the first component is non-metallic and the second component is metallic. Alternatively, both the first and second components are non-metallic. Each metallic component may be elemental or it may be an alloy, metallic or semi-metallic compound. If the component is a non-metallic component it may be for example an inorganic material such as a salt or mixture of salts. Binder materials may also be present in the alloy but are specifically chosen to not participate or affect the miscibility of the components thereof, or its phase-change characteristics.

Table 1, below, shows a range of alloy systems expected to be incorporated as the particulate second component comprising the inverse microstructure miscibility gap alloys of the present invention.

The transition temperature is the melting point of the low melting point (dispersed) component and which dictates the storage temperature properties of the material. The Table also shows the relative composition ranges of the elements comprising the particulate second component of the present invention.

TABLE 1

Potential particulate components comprising the miscibility gap thermal storage systems.

| 2nd (Particulate) Component System | Transition T (° C.) | Composition (Mass % of Elements Within Particulate Component) |
|---|---|---|
| Al | 660 | — |
| Al—Si | 577 | 12% Si:Bal Al |
| Al—Si | 577-1040 | 5-50% Si:Bal Al |
| Zn | 419 | — |
| Mg | 650 | — |
| Cu | 1085 | — |
| Pb | 327 | — |
| Bi | 270 | — |
| Cu—P | 725 | 92 Cu:8 P |
| Cu—Mg | 725 | 89 Cu:11 Mg |
| $Cu_2Mg$ | 797 | 84 Cu:16 Mg |
| Cu—Mg | 552 | 65 Cu:35 Mg |
| Cu—Mg | 487 | 33 Cu:67 Mg |
| Cu—Si | 802 | 86 Cu:14 Si |
| $MgCl_2$ | 714 | — |
| Al—Mg—Si | 555-700 | 50 Al:19 Mg:31 Si |
| Al—Mg—Si | 575-675 | 65 Al:17 Mg:18 Si |
| Al—Mg—Si | 500-650 | 37 Al:25 Mg:38 Si |
| Al—Mg—Si | 500-900 | 40 Al:Bal Mg:Bal Si |
| Al—Mg—Si | 500-900 | 50 Al:Bal Mg:Bal Si |
| Al—Mg—Si | 500-900 | 60 Al:Bal Mg:Bal Si |
| Al—Mg—Si | 500-900 | 70 Al:Bal Mg:Bal Si |
| Al—Mg—Si | 500-900 | 80 Al:Bal Mg:Bal Si |
| Al—Mg—Si | 500-900 | 90 Al:Bal Mg:Bal Si |
| Al—Cu—Si | 525-650 | 50 Al:35 Cu:15 Si |
| Al—Cu—Si | 525-650 | 50 Al:45 Cu:5 Si |
| Al—Cu—Si | 525-650 | 40 Al:40 Cu:20 Si |
| Al—Cu—Si | 500-650 (Estimate) | 30 Al:55 Cu:15 Si |
| Al—Cu—Si | 500-650 (Estimate) | 30 Al:60 Cu:10 Si |
| Al—Cu—Si | 500-650 (Estimate) | 20 Al:65 Cu:15 Si |
| Cu—Mg—Si | 700-850 | 32 Cu:38 Mg:30 Si |
| Cu—Mg—Si | 700-850 | 53 Cu:22 Mg:25 Si |
| Cu—Mg—Si | 700-850 | 50 Cu:25 Mg:25 Si |
| Cu—Mg—Si | 750-850 | 54 Cu:24 Mg:22 Si |
| Cu—Mg—Si | 742 | 56 Cu:17 Mg:27 Si |
| Cu—Mg—Si | 700-850 (Estimate) | 38 Cu:29 Mg:33 Si |
| Cu—Mg—Si | 700-850 (Estimate) | 51 Cu:19 Mg:30 Si |
| Cu—Mg—Si | 700-850 (Estimate) | 61 Cu:12 Mg:27 Si |
| Cu—Mg—Si | 700-850 (Estimate) | 21 Cu:41 Mg:38 Si |
| Cu—Mg—Si | 700-800 | 53.1 Cu:21.5 Mg:25.4 Si |
| Cu—Mg—Si | 700-800 | 53.5 Cu:22.2 Mg:24.3 Si |
| Zn—Cu—Mg | 703 | 49 Zn:45 Cu:6 Mg |
| Mg—Si | 946 | 48 Mg:52 Si |
| Mg—Bi | 546 | 13 Mg:87 Bi |
| Al—Cu | 552 | 68 Al:32 Cu |
| Al—Mg—Zn | 400-660 | 20 Al:Bal Mg:Bal Zn |
| Al—Mg—Zn | 400-660 | 30 Al:Bal Mg:Bal Zn |
| Al—Mg—Zn | 400-660 | 40 Al:Bal Mg:Bal Zn |
| Al—Mg—Zn | 400-660 | 50 Al:Bal Mg:Bal Zn |
| Al—Mg—Zn | 400-660 | 60 Al:Bal Mg:Bal Zn |
| Al—Mg—Zn | 400-660 | 70 Al:Bal Mg:Bal Zn |
| Al—Mg—Zn | 400-660 | 80 Al:Bal Mg:Bal Zn |
| Al—Mg—Zn | 400-660 | 90 Al:Bal Mg:Bal Zn |

Preferably the second component is present in an amount of at least 30% by volume of the thermal storage material, more preferably the second component is present in an amount of at least 35% by volume of the thermal storage material, even more preferably the second component is present in an amount of at least 40% by volume of the thermal storage material or most preferably the second component is present in an amount of at least 50% by volume of the thermal storage material. Preferably the second component is present in an amount of less than about 70% by volume of the thermal storage material.

The particles are preferably sized so as to avoid problems due to thermal expansion. In one embodiment the particles of the second component are <100 μm or even <80 μm in size.

While any suitable alloy material can comprise the first matrix component of the miscibility gap alloy provided it can contain and encapsulate the particulate second component, it is preferably selected from the group consisting of Al, Fe, C and SiC. Preferably the second component is selected from the group consisting of Al, Bi, Mg, Cu, Zn and Si, or a combination thereof. In another preferred embodiment the first component is C and the second component is an alloy comprising any combination of Zn, Cu, Mg, Bi and Si. In another preferred embodiment the first component is C and the second component is an alloy of Al and Si. In another preferred embodiment the first component is C and the second component is an alloy of Al, Mg and Si. In another preferred embodiment the first component is C and the second component is an alloy of Cu, Mg and Si. In another preferred embodiment the first component is C and the second component is an alloy of Cu and P. In another preferred embodiment the first component is C and the second component is an alloy of Cu and Si. In another preferred embodiment the first component is C and the second component is an alloy of Cu and Zn. In another preferred embodiment the first component is C and the second component is an alloy of Cu and Al. In another preferred embodiment the first component is Al and the second component is Bi. In another preferred embodiment the first component is Fe and second component is Mg. In another preferred embodiment the first component is Fe and second component is Cu. In another preferred embodiment the first component is C in graphite form and second component is Cu. In another preferred embodiment the first component is SiC and the second component is Si.

Preferably, when the first component is Al, then the second component is not Pb in an amount of 3 to 26%

The inverse microstructure is such that the matrix of the first component contains and confines the second component, including when the second component is in a molten or flowable state.

It should be appreciated the materials described for both the first and second components are not listed exhaustively, but merely exemplify the types of materials that can be used depending upon the operating parameters selected.

Benefits of MGA in TES Systems

By utilising MGA thermal storage blocks, the invention is believed to be able to overcome the well known shortcomings of many current TES systems. The advantages of using such a material as the thermal storage block include:

- High energy density per unit volume by capitalising on the high latent heat of fusion per unit volume of metals. In many cases, 0.2-2.3 MJ/L at 50% loading of the active (melting) phase or even higher can be achieved. The volume of such storage devices is therefore relatively low compared to the energy they store.
- A range of melting temperatures for active phases are available and therefore the materials may be individually matched to useful operating temperatures: low temperatures (<300° C.) for applications such as space heating and industrial heat for food processing, mid-range temperatures (300° C.-400° C.) for process heat in chemical processing and high temperatures (400° C.-700° C.) for steam turbine electricity generation and even higher (700° C.-1400° C.) for high temperature industrial processes.

Latent heat is delivered (or accepted) over a narrow temperature range allowing more precise control of process parameters and, in terms of steam generation, would allow for easier matching of turbine-generator or other process equipment.

Since the heat is delivered to and retrieved from the PCM by conduction through the matrix component of the alloy alone, there is no need to transport the molten phase around the system and very high heat transfer rates are possible.

No special containment is necessary as the matrix phase remains solid at all times and encapsulates the active phase.

Chemical reactions between component materials are avoided as the two materials are thermodynamically stable and immiscible at the operating temperatures, which means the system is likely to remain stable over long periods of time.

The use of thermodynamically stable or metastable immiscible materials presents a new direction for developing efficient TES using the latent heat of fusion. Material systems can be selected to match the desired working temperature. No external confinement is required as the matrix phase is solid at all times and remains self-supporting. This simplifies the design and improves the safety aspects of large PCM storage tanks as hydraulic pressures are never developed and volume changes on freezing/melting are restricted to within the volume of small active phase particles.

The class of miscibility gap alloys disclosed herein have the capability to considerably reduce demand for conventional forms of energy through, for example, the use of concentrated solar radiation or industrial waste heat recovery and utilisation. This will by definition reduce demand for fossil fuel generated energy leading to substantial environmental gains.

Thermal energy storage is well known, and it is estimated that of the global advanced energy storage capacity of around 2000 MW, more than half is stored thermally or in the form of molten salt. The inverse microstructure alloys would potentially be able to secure a large portion of that sector by directly replacing thermal storage materials and associated pumps, heat exchangers, pipework and the like.

With the optimisation of the thermal storage materials of the present invention, renewable electricity generation becomes increasingly feasible as the intermittency problem due to wind conditions, weather and the diurnal cycle is overcome in a way that allows the use of conventional steam turbine technology as well as advanced power cycles still under development such as supercritical $CO_2$ Brayton cycle turbines.

Heat Transfer Fluids

As discussed above, heat transfer channels are provided in the thermal storage body to charge and discharge thermal energy thereto and therefrom, respectively. Heat transfer fluids are flowed inside these channels to transfer heat between the at least one MGA thermal storage block by a combination of conduction and convection. The transfer of heat between the fluid and the MGA can be performed directly by flowing the heat transfer fluid directly over/past the heat transfer blocks, or indirectly via the pipe walls of a heat exchanger apparatus in contact with said at least one block or through a highly conductive intermediate material surrounding said pipes to reduce thermal interface losses.

In the context of the present invention, a heat transfer fluid is a medium (such as a gas, liquid or supercritical gas) which facilitates the transfer of thermal energy to and from the thermal storage body, and thus the energy storage device. In certain embodiments where the energy storage device is connected to a generation apparatus, the heat transfer fluid can be used to conductively transfer heat from the thermal storage body, and conventionally transfer this by forced fluid flow in a heat exchanger to a generator for electro-mechanical conversion to electrical energy.

In this regard, the heat transfer fluid comprises any medium than can be flowed as a fluid, and as discussed above can transfer thermal energy by both conduction and convection. Accordingly, the heat transfer fluid can include, but is not limited to thermal oils, water, steam, nitrogen, argon, hydrocarbons, and carbon dioxide ($CO_2$). In one embodiment the forced flow of the heat transfer fluid through the at least one heat transfer channel and past the thermal storage body is facilitated by at least one opening located at each end of said channel, fluidly and/or thermally connecting the at least one heat storage block adjacent to the channel(s) to the external atmosphere or any external apparatuses such as a generator, a heat exchanger and/or a cooler.

In some embodiments the extracted heat is directly injected into an industrial or commercial process requiring thermal energy either using the heat transfer fluid extracting the energy or a secondary heat transfer fluid such as steam using a secondary heat exchanger.

In embodiments where the energy storage device is connected to an electrical generator, the person skilled in the art would appreciate that the heat transfer fluid would be chosen according to the generation mechanism used, the temperature targeted and the heat exchanger used. Generation methods that can be driven by thermal energy discharged from the energy storage device can include, but are not limited to, Rankine cycle turbine-generators, Brayton cycle turbine-generators, Barton cycle engines, Sterling engines and gas turbines. For example, a Brayton cycle turbine-generator may use supercritical fluids such as supercritical $CO_2$ as the heat transfer fluid. Alternatively, the heated heat transfer fluid can be fed into an intermediate heat exchanging process to heat another fluid such as a working fluid to power any said turbines/generators.

Preferably, heat is transferred from the thermal storage body and discharged to a steam-driven turbine by flowing steam generated from auxiliary heat recovery processes from the heat transfer fluid through the at least one heat transfer channel. This steam is generated from Heat Recovery Steam Generators (HRSG) located externally relative to the energy storage device wherein steam is generated from heat transfer fluid which has been heated by passing through the heat transfer channels within the thermal storage body. In another embodiment, a heat exchanger (including, but not limited to a HRSG), energy storage device and turbine generator form closed or recirculating loops, including pumps and other cooling apparatuses to charge/discharge, generate electricity and drive the fluid circulation. Alternatively, waste heat from an industrial process can be transferred to and stored in the energy storage device by passing through a heat transfer fluid for dispatch at a later opportunity.

Heating Device

At least one heating device is provided in the energy storage device to charge energy in the form of thermal energy into the thermal storage body. This at least one heating device is placed in a position adjacent to or inside the at least one thermal storage block such that thermal energy in form of conductive, convective or radiant heat can be transferred from the heating device to the thermal storage body. Accordingly, the heating device can be placed along or inside the heat transfer channel formed in the thermal transfer body such that it is received by it, or placed adjacent to internal and/or external surfaces of the thermal storage body. In this regard, the person skilled in the art would appreciate that the number of heating devices, its position relative to the thermal storage body and the heat transfer mechanism used would be chosen according to factors including, but not limited to, the materials used in the thermal storage body, the type of energy being converted into thermal energy and the desired energy transfer rate.

The provision of more than one heating device adjacent to, or located in the thermal transfer channel of, the thermal storage body can provide a more uniform and rapid heat transfer to the thermal storage body. For example, each sub-unit of the thermal storage body can comprise anywhere between two and several hundred such heating devices such that the thermal storage blocks comprised therein are heated efficiently and uniformly.

In certain embodiments, the at least one heating device comprises one or more electrical resistor elements. Such a heating device would be able to convert electrical energy supplied to the energy storage device in order to directly heat the thermal storage body. In further embodiments, the at least one heating device is an electrically-driven radiant heater which is adapted to heat the thermal storage blocks by electro-magnetic radiation generated by the one or more resistor elements comprising therein. This EM radiation is preferably comprised of primarily infrared radiation.

In a preferable embodiment, a radiating portion of the heating device, comprising the at least one resistor element as a radiation source, is held at a predetermined distance from the thermal storage blocks, thereby transferring heat by radiation when energised. According to the radiative mechanism used, improved thermal transfer is achieved by holding the radiating portion at said distance rather than bringing it into contact with the at least one thermal storage block. In contrast to conductive or convective heat transfer, a radiative heating device provides improved heat transfer during thermal charging of the miscibility gap alloys forming the thermal storage blocks owing to the high-density and conductive continuous matrix of the first material comprising said MGA material. In use, the radiated heat is transferred to the thermal storage body and then by conduction to the internal portion of the MGA thermal storage block, effectively heating both the conductive first material and the fusable second material comprised therein. Advantageously, the use of a non-contacting radiative heating device also facilitates effective and efficient electrical insulation of the MGA material comprising the at least one thermal storage block. Furthermore, the use of an efficient, typically electrically-driven, heating device separate from the discharge pathway provided by the flow of heat transfer fluids allows the energy storage device to simultaneously charge and discharge thermal energy via the respective pathways—an operating mode not possible in chemical energy storage devices.

While the skilled addressee would readily appreciate that the at least one heating device can take any specific form, such as a rod or panel-shaped heating device located near or adjacent to the at least one thermal storage block. In this regard, one or more radiative heaters can be placed on external surfaces of the thermal storage block, or in internal cavities thereof such that radiative heat transfer is facilitated. The panel structure effectively maximises the radiative surface for heat transfer between it and the at least one thermal storage block. In this regard, each radiative heating device can also comprise any suitable number of resistor elements depending on factors, including but not limited to, charging temperature, heat transfer rate, size of heating element and power efficiency of the heating device.

In another embodiment electrical resistive heaters can be located in the heat transfer fluid circulation system for example within the inlet duct of the thermal energy storage body. This alternate location for the heaters allows the heat transfer fluid system to heat the storage blocks.

Operation

Operation of the energy storage device will now be discussed.

In a second aspect of the present invention, there is provided a method for storing energy comprising:

a) thermally charging at least one thermal storage block comprising a thermal storage unit by heating at least one heating unit adjacent to at least one thermal transfer channel formed therein;

b) storing said thermal energy in said thermal storage blocks by substantially insulating said thermal storage unit comprised therefrom, from the outside atmosphere; and c) thermally discharging heat from the thermal storage unit by flowing a heat transfer fluid of a lower temperature in the at least one heat transfer channel such that heat is removed from the at least one thermal transfer block.

Accordingly, thermal energy is charged, stored and discharged from the energy storage device by heating, maintaining temperature and transferring the heat away from the at least one thermal storage block comprising therein. As such, there are three distinct phases to the device's operation.—namely charge, storage and discharge phases described in steps a), b) and c), respectively.

Under the charging phase, thermal energy is input into the thermal storage body by the at least one heating device. In one embodiment, the heating device is an electrical heater used to convert electrical energy to thermal energy. In an even more preferable embodiment, thermal energy is radiantly transferred to the thermal storage blocks using a radiant electrical heater.

As a result of the thermal energy input into the thermal storage body, the at least one thermal storage block comprising therein will sensibly heat up until the second phase of the miscibility gap alloy material forming said block melts inside the solid conductive first phase. In melting (or fusing), further energy is absorbed inside said block in the form of latent energy of fusion or transformation. Considering the discharged form of the MGA material is to have both first and second phases as solids, this additional latent energy of fusion is effectively stored inside the storage block until release and transformation of the second phase back to a solid.

In certain embodiments, the energy storage device is configured such that the at least one heating device is able to charge the thermal storage body with up to between 2 kWh and 10 GWh of energy over a certain period, spanning from several minutes to multiple days. In one non-limiting deployment of the invention, both the heating device and the thermal storage body are adapted to transfer 300 KW of thermal energy into the latter over a 5 to 14 hour period per day of operation. In another embodiment, the electrical energy for the at least one heating device is supplied by a renewable generation, including but not limited to solar, wind and/or any surplus renewably generated power from the electrical grid.

During the storage phase, thermal energy is stored in the charged at least one thermal energy block by insulating the thermal storage body it comprises from the external atmosphere. In this regard, thermal insulation material is configured to surround said storage body to substantially insulate it. In certain, non-limiting embodiments, the insulation, combined with the thermal storage blocks, are adapted to substantially maintain 2 kW h to 100 TW h of thermal energy within the thermal storage body for up to between 50 to 500 hours after charging. In one deployment, the energy storage device is configured such that thermal energy totalling 500 kW h (1.8 GJ) can be stored for up to 96 hours.

In another non-limiting embodiment, the device is adapted to charge and store up to 5 MW h of thermal energy and release or dispatch said energy at rates as fast as to 500 KW over 4 hours.

Under energy discharge, the direct contact allows heat to be conducted/convected from the heated thermal storage to the flowing cooler heat transfer fluid directly, or through a heat exchanger wall. Preferably, the movement of the heat transfer fluid directly past and through the heat transfer channel facilitates the controlled extraction of thermal energy from the thermal storage body, without any contact resistance or thermal interface losses between the storage material and an internal heat exchanger.

Where "inverse" microstructure miscibility gap alloys (MGAs) are used to form the at least one thermal storage block, said block(s) will release intense bursts of latent heat locally during discharge (solidification of the active second phase) which is then conducted away by the surrounding matrix phase to the heat transfer fluid. This release of energy is in addition to the aforementioned release/transfer of sensible energy stored in the thermal storage body.

In certain embodiments, the energy storage device is configured to discharge between 300 KW h to 400 MW h of thermal energy therefrom, over an extended period spanning 2 to 24 hours. In one deployment of the invention, the heat transfer fluid flow and conductivity of fluid, block material and insulation are adapted such that 500 KW h of thermal energy can be controllably discharged over a 4 hour period. Throughout the above discharge periods, a thermal discharge rate of between 100 KW and 500 MW is maintained to keep the heat transfer fluid discharge temperature above 300 to 800 deg. C. In the exemplary deployment discussed above, the energy storage device is able to maintain a thermal discharge rate of 100 to 125 KW over a 4 hour period, during which the heat transfer fluid temperature at its outlet is maintained above 500 deg. C.

Accordingly, in a third aspect of the present invention, there is provided a system for storing energy comprising the following unit operations:

at least one energy source;

at least one energy storage device comprising: at least one heating device; a thermal storage body comprising at least one thermal storage block formed from a miscibility gap alloy, wherein said at least one thermal storage block is arranged such that at least one heat transfer channel adapted to receive heat transfer fluid flow and/or said at least one heating device is formed therein; thermal insulation surrounding said thermal storage body such that said thermal storage body is substantially thermally insulated; and at least one substantially impermeable shell surrounding the thermal storage body and/or the thermal insulation such that the heat transfer fluid is substantially contained, wherein heat can be charged or discharged from said thermal storage body by thermal transfer between said at least one heat transfer channel and at least one thermal storage block;

at least one pumping means; and at least one heat transfer and/or energy conversion means, wherein said unit operations are in fluid communication with each other such that said system forms at least one fluid pass for transferring thermal energy therebetween.

The person skilled in the art would appreciate that the thermal discharge rate in this regard can be controlled through the heat transfer fluid flowrate and pressure through the heat transfer channel.

Definitions

In describing and claiming the present invention, the following terminology will be used in accordance with the definitions set out below. It is also to be understood that the terminology used herein is for the purpose of describing particular embodiments of the invention only and is not intended to be limiting. Unless defined otherwise, all technical and scientific terms used herein have the same meaning as commonly understood by one having ordinary skill in the art to which the invention pertains.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

As used herein, the phrase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising", "consisting of", and "consisting essentially of", where one of these three terms is used herein, the presently disclosed and claimed subject matter may include the use of either of the other two terms. Thus, in some embodiments not otherwise explicitly recited, any instance of "comprising" may be replaced by "consisting of" or, alternatively, by "consisting essentially of".

Other than in the operating examples, or where otherwise indicated, all numbers expressing quantities of ingredients or reaction conditions used herein are to be understood as modified in all instances by the term "about". The examples are not intended to limit the scope of the invention. In what follows, or where otherwise indicated, "%" will mean "volume %", "ratio" will mean "volume ratio" and "parts" will mean "volume parts".

The term 'substantially' as used herein shall mean comprising more than 50% by volume, mass or weight, according to the context is it used, unless otherwise indicated. Preferably, it is meant to mean more than 75%. Even more preferably, it is meant to mean more than 90%. Most preferably, it is meant to mean 100% or close to 100%.

The recitation of a numerical range using endpoints includes all numbers subsumed within that range (e.g., 1 to 5 includes 1, 1.5, 2, 2.75, 3, 3.80, 4, 5 etc.).

The terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the invention.

It must also be noted that, as used in the specification and the appended claims, the singular forms "a", "an" and "the" include plural referents unless the context clearly dictates otherwise.

The prior art referred to herein is fully incorporated herein by reference.

Although exemplary embodiments of the disclosed technology are explained in detail herein, it is to be understood that other embodiments are contemplated. Accordingly, it is not intended that the disclosed technology be limited in its scope to the details of construction and arrangement of components set forth in the following description or illustrated in the drawings. The disclosed technology is capable of other embodiments and of being practiced or carried out in various ways.

BRIEF DESCRIPTION OF THE DRAWINGS

The invention will now be described, by way of example with reference to the accompanying drawings, in which.

DETAILED DESCRIPTION OF THE INVENTION

The skilled addressee will understand that the invention comprises the embodiments and features disclosed herein as well as all combinations and/or permutations of the disclosed embodiments and features.

Example 1—Direct Extraction

Figure 1:
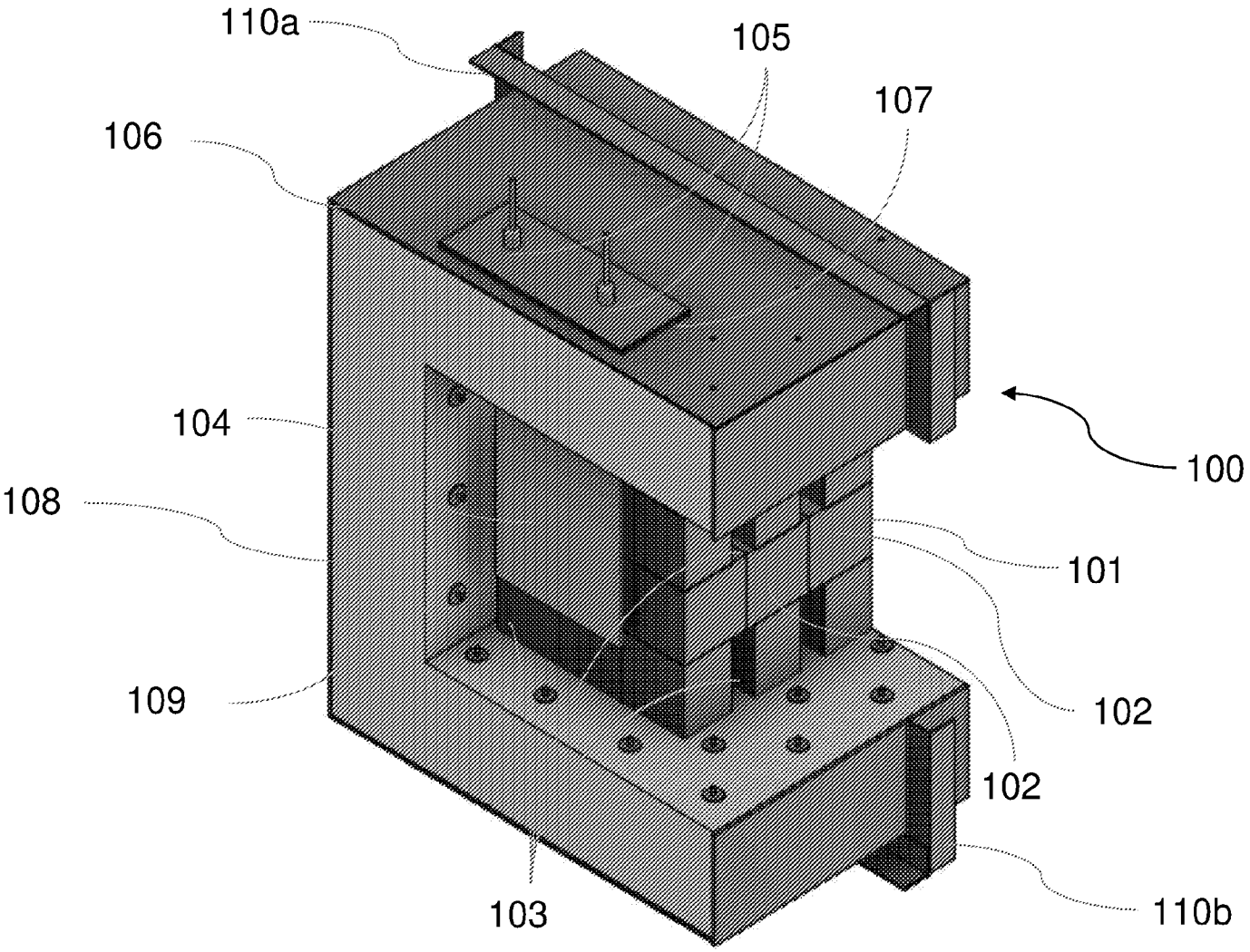
FIG. 1 is a cutaway view of the energy storage device showing heat transfer channels formed by the assembly of a plurality of thermal storage blocks surrounded by insulation panels.

Referring to FIG. 1, there is shown the internal structure of an energy storage device 100 comprising a thermal storage body 101 formed from a plurality of miscibility gap alloy thermal storage blocks 102. This thermal storage body 101 is assembled by the plurality of thermal storage blocks 102 which are milled, machined, stacked in an arrangement or the like to provide a plurality of heating element channels 103 adapted to receive a flow of heat transfer fluids when assembled.

Located adjacent to the thermal storage body in one of the heat transfer channels is a panel-shaped heating device 104. This heating device is an electrically resistive heater with at least one resistive element electrically powered via electrical leads or busbars 105. The panel heating device 104 is received in the heat transfer channel 103 and secured to the gas-sealed outer-shell 106 of the energy storage device 100 by mounting brackets 107. The mounting brackets 107 can be adjusted to bring the panel heating device 104 into contact with the thermal storage body 101, or at a certain distance therefrom, depending on the heat transfer rate and type (i.e. radiation, convection and/or conduction) desired by the skilled addressee. The embodiment shown in FIG. 1 comprises a panel-style heating device 104 close to, but not in contact with, the thermal storage blocks 102. The bracket-based mounting of heating device 104 to the outer-shell 106 allows for independent adjustment, extraction and/or replacement thereof. The heating device 104, mounting bracket 107 and outer-shell 106 comprise appropriate gas-sealing materials such as rubber, ceramic or soldering gaskets such that the energy storage device 100 is substantially gas-tight and thermally insulated during use.

Insulative material, shown in FIG. 1 as thicker insulation panels 108, is provided on the inner surface of the outer-shell 106. The insulation panels 108 are constructed and positioned such that when in use, the thermal storage body 101 and the heat transfer fluids received in the heat transfer channel 103 are substantially thermally insulated from the outside atmosphere. The insulation panels 108 are internally positioned and mounted to the outer shell 106 by pins 109, such that said insulation panels 108 are held in abutting engagement.

Finally, the outer-shell 106 comprises weight-bearing frame and feet 110*a* and 110*b* that provide substantial structural rigidity and support to the energy storage device 100 such that it is able to support its own weight when placed on a surface, as well as supporting the weight of at least another energy storage device placed above it. In the embodiment shown, the upper feet 110*a* and lower feet 110*b* are shaped in a complementary fashion such that they can be secured using hook-and-loop engagement when the energy storage devices 100 are placed on top of each other.

Figure 2:
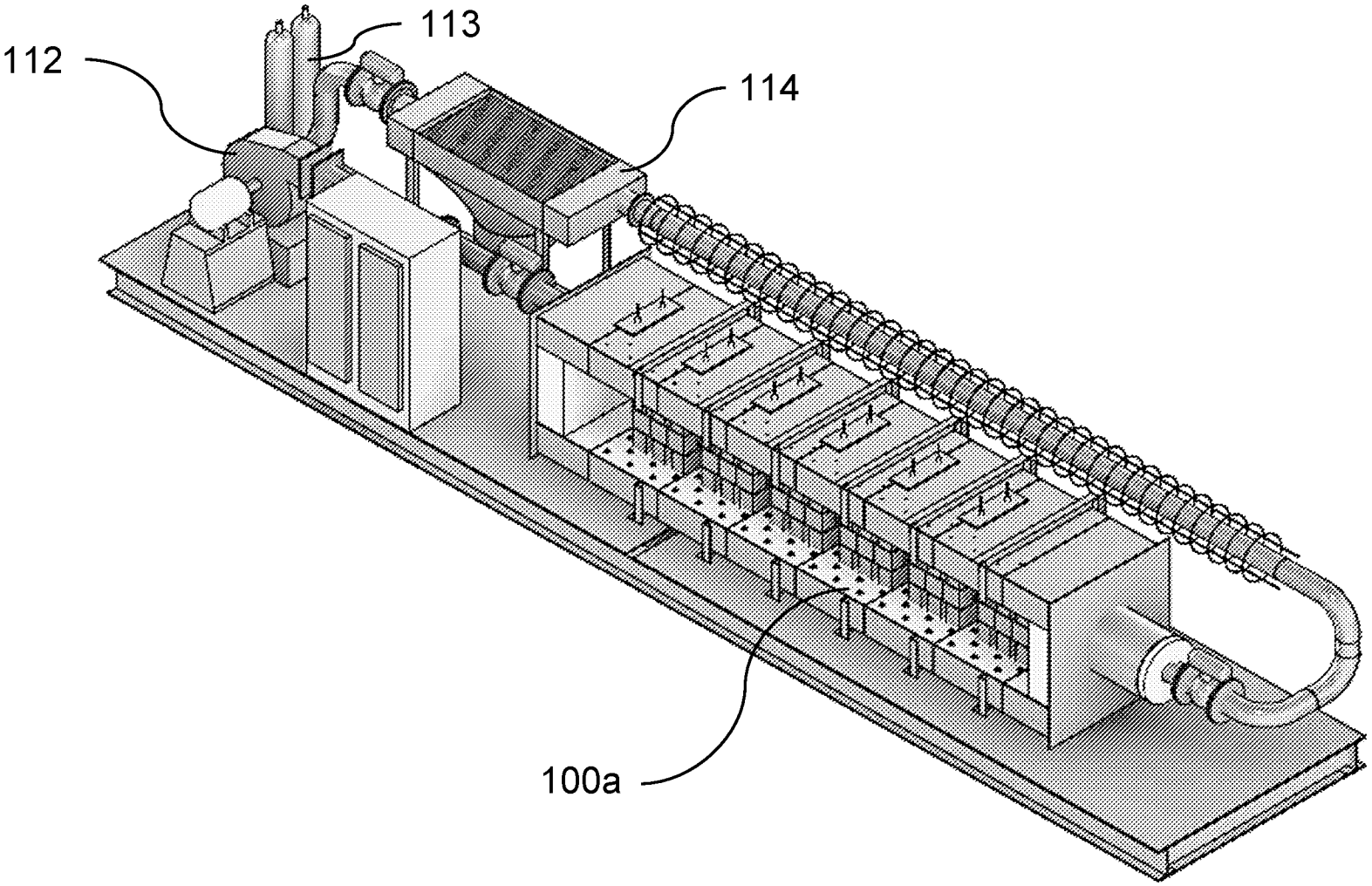
FIG. 2 is an orthographic view of the energy storage device as part of a closed loop thermal dispatch arrangement with a pump and an external heat exchanger.

The energy storage and heat transfer system shown in FIG. 2 comprises a plurality of energy storage devices 100 as a series of subunits in fluid communication with each other, collectively forming a large-scale energy storage device 100*a*. In this embodiment, this larger storage device 100*a* is also in fluid communication with a fluid pump 112, a heat transfer fluid reservoir 113 and a heat exchanger 114, forming a recirculating closed loop arrangement.

In the specific embodiment shown, the fluid pump 112 is a motive fan or blower adapted to pump substantially gaseous heat transfer fluids such as steam, hydrocarbons, sub-critical $CO_2$ and/or nitrogen throughout the loop and its constituent unit operations. In this regard, the blower is sized as to provide enough head and flow throughout both the heat exchanger 114 and energy storage device 100*a* to maintain the flow rate and fluid velocity required for heat transfer and the prevention of fouling in both respective unit operations.

In line with the gaseous heat transfer fluid, a gas cooler heat exchanger is selected in this embodiment as the heat exchanger 114. The heat transfer fluid heated by the discharge of thermal energy from the thermal storage body 101 to said fluid flowing therethrough is sent to the gas-cooler heat exchanger 114 where it is brought into thermal communication with another heat transfer or working fluid by passing both fluids through a shell and tube heat exchanger arrangement. The device comprising the heat exchanger 114 can be selected and changed depending on the usage and purpose of the thermal energy discharged from the energy storage device 100*a*. For example, a shell and tube heat exchanger may be used to transfer the energy to a working fluid for spinning a turbine for electrical generation, or alternatively the heat can be transferred to another heat transfer fluid such as water for heating industrial processes via a spray-contact heat exchanger.

Figure 3:
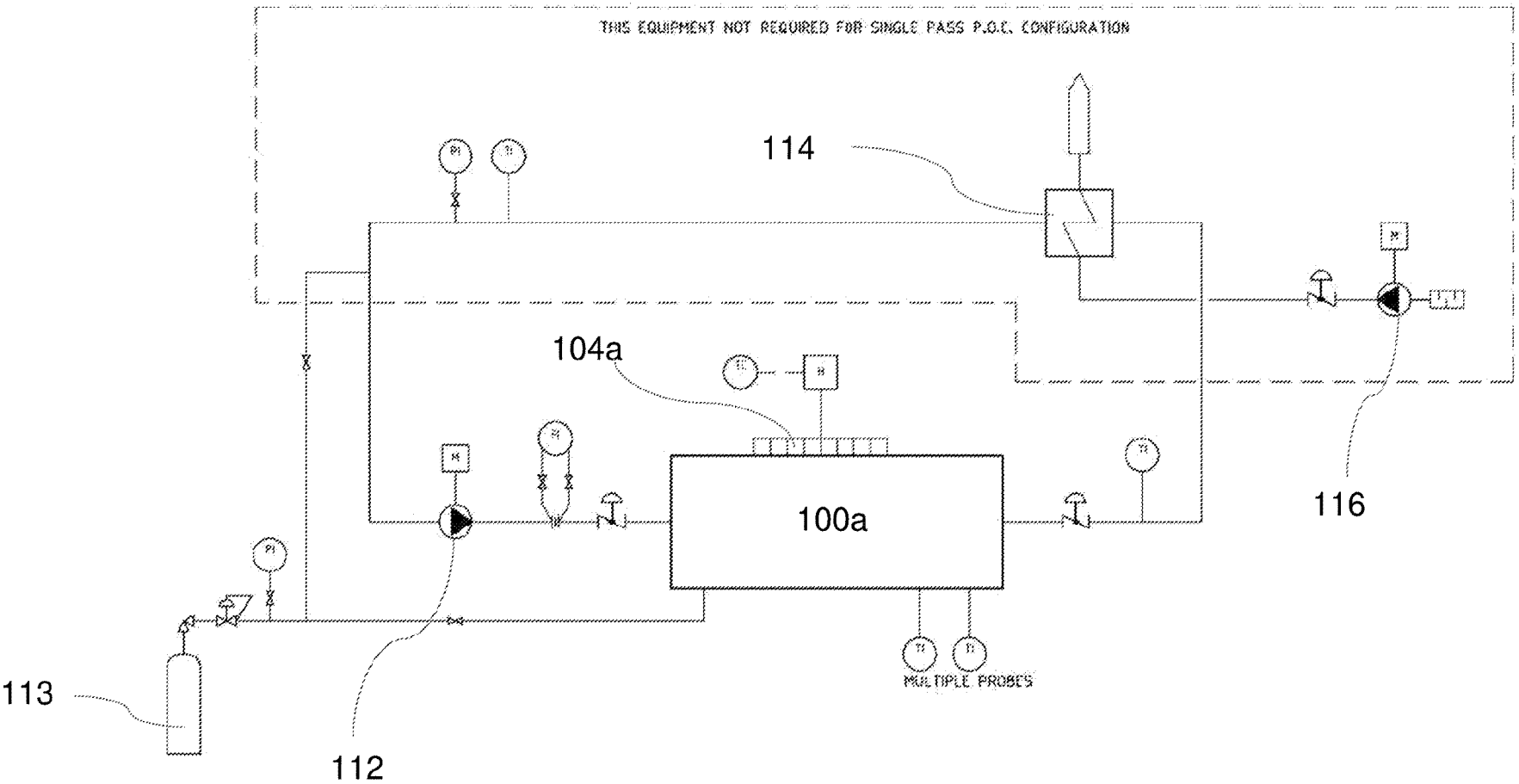
FIG. 3 is a piping and instrumentation diagram showing the energy storage device as part of a closed loop arrangement including a gas-cooler heat exchanger.

A simplified process flow of FIG. 2's embodiment is further explained in the piping and instrumentation diagram (P&ID) shown in FIG. 3. As discussed above, the energy storage device 100*a*, blower 112 and heat exchanger 114 are in fluid connection within a closed loop recirculating the heat transfer fluid. A heat transfer fluid reservoir 113 in the form of a tank is also provided, and is fluidically connected to channel 115 bypassing the blower 112 of the loop. The valves attached to these bypass and reservoir feed channels are used to control pumping pressure, as well as heat transfer fluid levels inside the closed loop.

Also included in FIG. 3 is a coolant-side pump 116 for pumping the at least another heat transfer or working fluid cooling the heat transfer fluid heated from the energy storage device 100*a*. As labelled in the P&ID and discussed above, the energy storage device 100*a* is not limited to being connected to a heat exchanger, nor is its use limited to heating a secondary heat transfer or working fluid. In this regard, the skilled addressee would appreciate that the energy storage device 100*a* would be able to directly power a selection of industrial and generation devices, including but not limited to at least one steam turbine and a Rankine cycle generator in a single pass configuration without a secondary fluid.

Further to the above, various sensors including Flow (FI), Temperature (TI) and Pressure (PI) sensors, controllers, motors, heaters and valves are attached to the embodiment to monitor and control the charge, discharge and heat transfer processes. It is specifically noted that the energy storage device 100*a* are monitored by multiple probes including temperature sensors, while the plurality of heaters forming a heater array 104*a* inserted thereinto are also controlled by a temperature controller (TC). The skilled addressee would appreciate that the above components, including the heater array 104*a* can be controlled manually, or using a computer control system in communication with them. As an example, a feedback control regime for the thermal charging process can be implemented using a proportional integral derivative (PID) controller in communication with the TC for the heating array 104*a* and the TI sensors of the energy storage device 100*a*. Furthermore, the temperature, pressure and flow sensors, TI, PI and FI respectively, monitoring the heat transfer fluid can also be incorporated into a control regime alongside valves flowing into and out of the energy storage device 100*a* to control the heat transfer fluid flow and heat transfer rates to control and determine device conditions during start-up, steady state operation and shut down.

Example 2—Indirect Extraction

Figure 4:
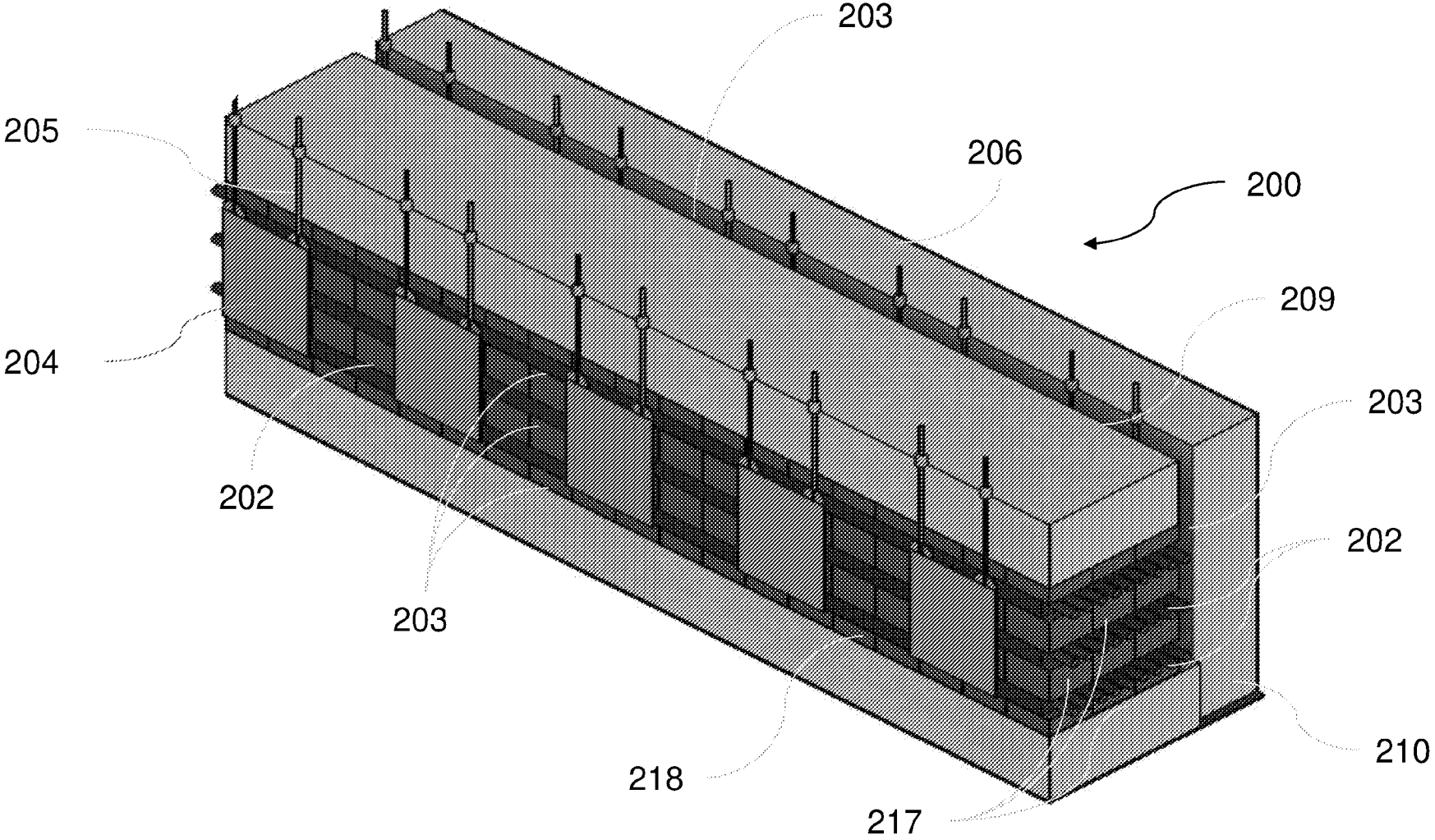
FIG. 4 is a cutaway view of an embodiment of the energy storage device involving flowing the heat transfer fluids through heat exchanger pipes.

Referring to an embodiment shown in FIG. 4, the energy storage device 200 can comprise an array of heat exchanger pipes 217 and intermediate material 218 surrounding said array, both received in heat transfer channels 203 formed by a plurality of thermal storage blocks 202 comprising the thermal storage body 201. In use during the discharge phase, the heat transfer fluid is flowed through the heat exchanger pipes 217 to conductively receive thermal energy from the thermal storage blocks 202, through the intermediate material 218 surrounding said pipes 217.

The intermediate material 218 is formed of dense, highly thermally conductive material such as silicon carbide or graphite adapted to conduct heat rapidly and efficiently between the heat exchanger pipe walls and the miscibility gap alloy thermal storage blocks 202. By assembling the thermal storage body 201 to comprise an alternating layered structure of thermal storage blocks 202 and the heat transfer channels 203, the embodiment of FIG. 3 eliminates the lossy pipe-to-MGA interface and replaces it with a buffer intermediate material 218 that displays improved thermal interfacing with both MGA and typical heat exchanger pipe materials such as copper, aluminium, boiler steels, stainless steel and Inconel.

Similarly, an array of panel-shaped heating devices 204 are provided adjacent to the thermal storage body 201 along the heat transfer channels 203*a* between the thermal storage body 201 and the inner-shell 209 of the energy storage device 200. Similar to the direct fluid transfer embodiment, the heating devices 204 are powered by electricity supplied through the leads 205. The inner-shell 209, the insulation panels 210 and the outer-shell are all constructed such that they provide a substantially gas-tight and thermally insulated seal around the thermal storage body 201 to hold the stored thermal energy during the storage phase.

Example 3—Thermodynamic Analyses

Figure 5:
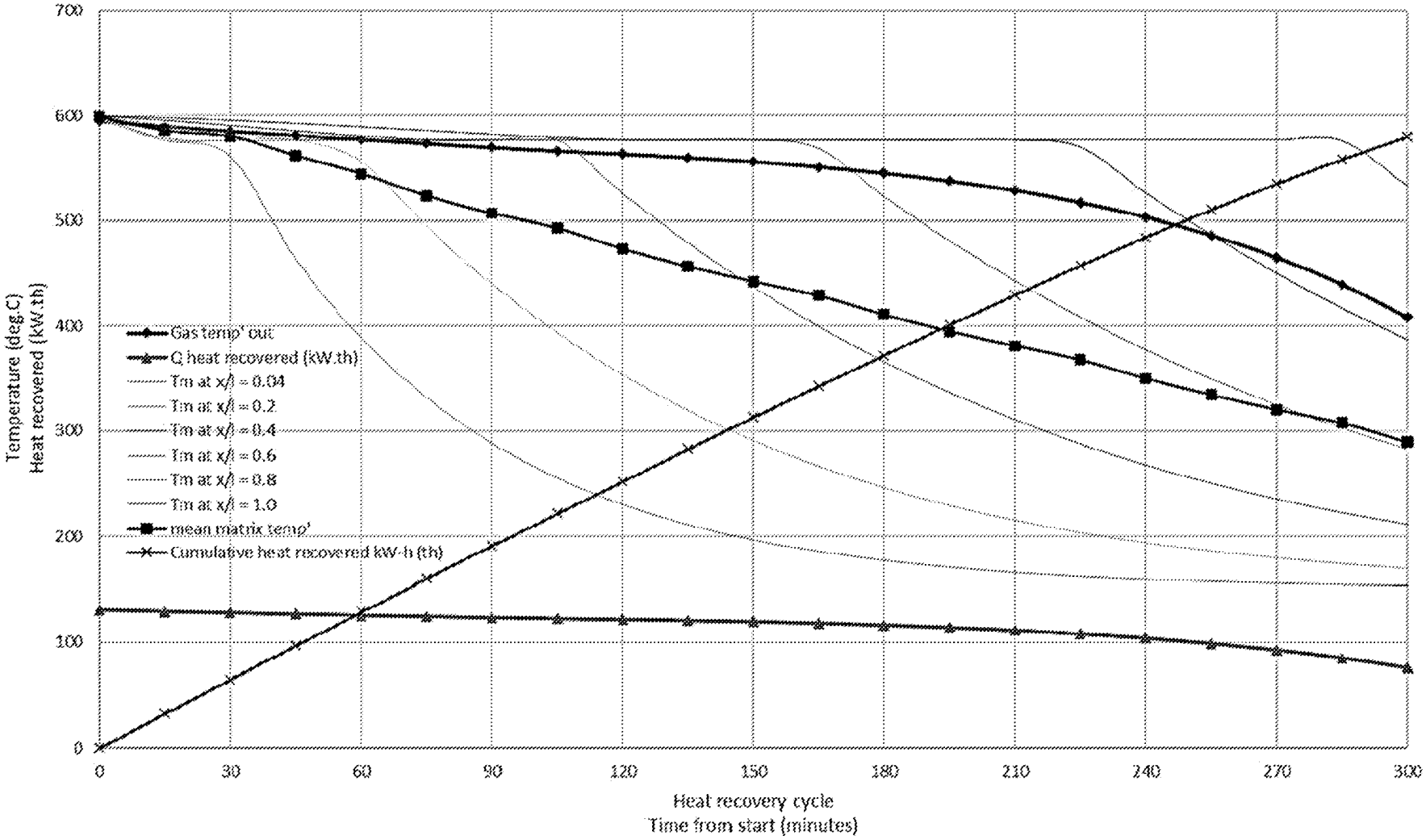
FIG. 5 shows a graphical representation of thermodynamic conditions during the discharge phase of the invention.

The expected thermal performance during the discharge phase of the embodiment shown in Example 1 is disclosed in FIG. 5. From a steady state internal temperature of 600 deg. Celsius held during the storage phase, the heat transfer fluid circulation is started and maintained at a flow rate such that a relatively constant thermal discharge rate of 100 to 130 KW is maintained.

The expected results show that the embodiment described in Example 1 is able to maintain a relatively constant thermal discharge output, while also maintaining discharge fluid temperatures above 500 deg. C. for more than 240 minutes (4 hours) of continuous thermal discharge. In this regard, maintaining 500 deg. C. for up to 4 hours is advantageous, as discharge temperatures in the range of 400 to 700 deg. C. is able to energize and power many industrial and power generation processes. Compared to thermal storage processes known in the art, the energy storage arrangement disclosed in Example 1 is able to maintain an operable and useful temperature for a longer period.

Example 4—Scale

Figure 6:
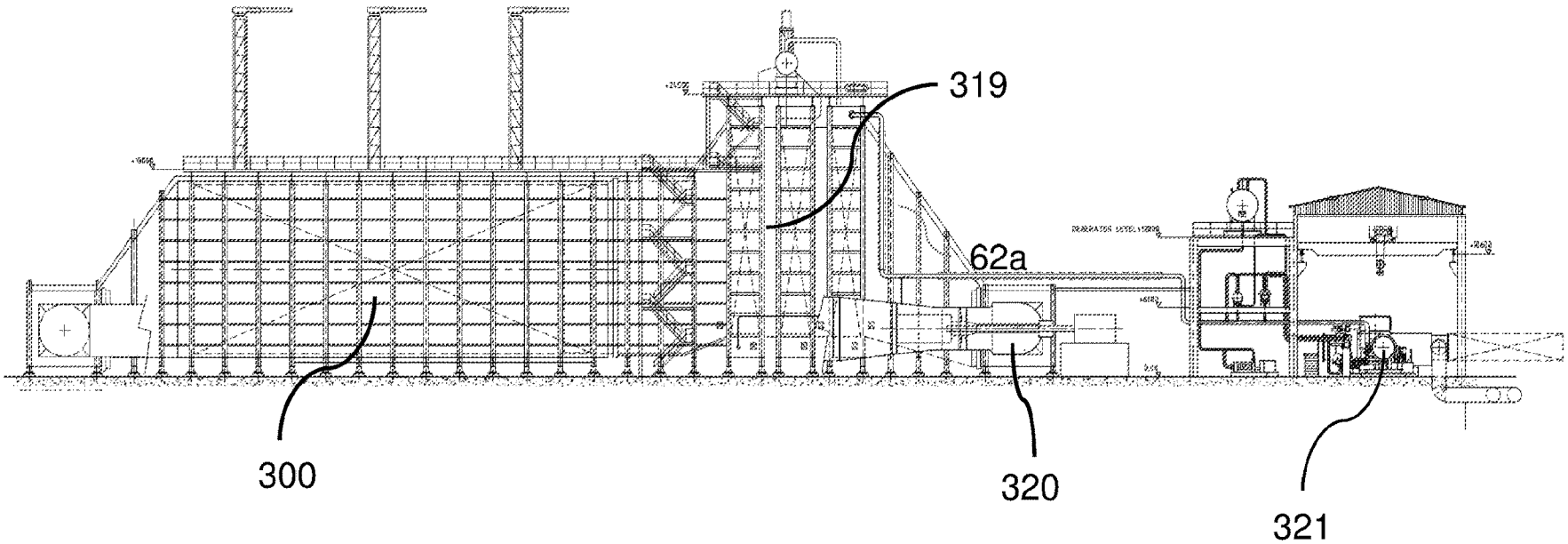
FIG. 6 is a side elevation view of a large-scale steam turbine-type power-generation arrangement using the energy storage device disclosed herein.

Referring to FIG. 6, the energy storage device disclosed can be scaled up in capacity to provide thermal energy for a grid-scale turbine generation system. In this embodiment, an array of energy storage devices are in fluid connection to form a larger device 300. This larger energy storage device 300 is in further fluid communication with a heat recovery steam generator (HRSG) 319 and a circulation fan 320 to power a steam turbine 321 in a two-pass configuration. In use, the thermal energy stored in the storage device 300 is discharged with the flow of a gaseous heat transfer fluid such as steam, air, sub-critical $CO_2$ or nitrogen to heat up and feed the hot fluid into the HRSG for recovery and heat transfer to a working fluid (steam in this case) to power the turbine. While the skilled addressee would appreciate that the energy storage device is scalable to provide various amounts of thermal energy for power-generation, the embodiment shown in FIG. 6 is scaled to generate 75 MW of dispatchable electricity from thermally storing intermittently generated renewable energy.

Those skilled in the art will appreciate that the invention described herein is susceptible to variations and modifications other than those specifically described. It is understood that the invention includes all such variations and modifications which fall within the spirit and scope of the present invention.

Example 5—Scaled Up Example 2

Figure 7A:
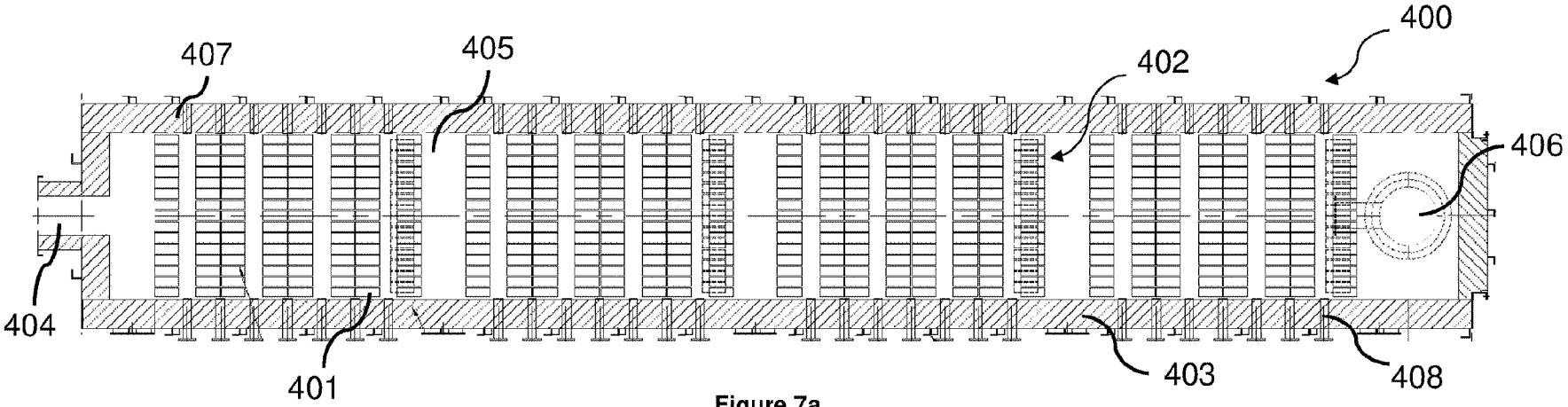
FIG. 7*a* is sectional plan view of an embodiment of the energy storage device, showing multiple thermal storage bodies encased in a thermally insulating containment structure.
Figure 7C:
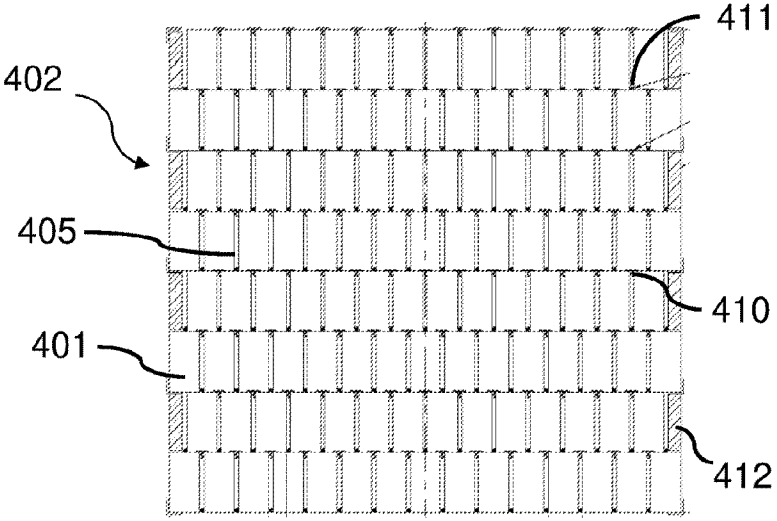
FIG. 7*c* is a close-up cross-section view of the thermal storage body shown in FIG. 7*b;*
Figure 7B:
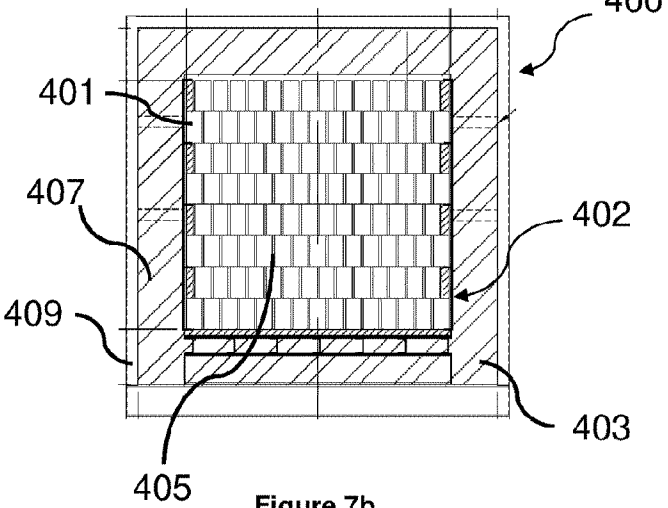
FIG. 7*b* is a horizontal cross-section view of said embodiment taken along line A-A, showing interstitial spaces between thermal storage blocks forming heat transfer channels.

Another scaled up version of the energy storage device 400 is disclosed in FIGS. 7*a* to 7*g*. Referring to FIGS. 7*a* to 7*c*, multiple arrays of multiple thermal storage blocks 401 each comprising a separate thermal storage body 402, all contained within a thermally insulated, substantially gas-tight containment structure 403. In this embodiment, four thermal storage bodies 402 are provided along the length of the elongated containment structure 403, such that a stream of gaseous heat transfer fluid introduced from the horizontally-facing aperture 404 is flows through said bodies via their heat transfer channels 405 located therethrough to the exit aperture 406 of said containment structure 403. The containment structure 403 is substantially thermally insulated by the insulation material 407, which is preferably 300 mm thick. Multiple heating element ports 408, each connected to a heating element (each single port 408 may be connected to a single heating element or multiple ports 408 may connected to a single heating element or a multiple heating elements may be connected to a single port 408) are provided the insulating material 407 and into the interstitial spaces between each said multiple thermal storage blocks 401 such that heating elements inserted therethrough can provide radiant heating during thermal charging of the thermal storage bodies 402.

Referring to FIG. 7*b*, the containment structure 403 includes a gas-tight casing 409 adapted to substantially prevent leakage of the heat transfer fluid from the thermal storage device 400. Moreover, the multiple electrical heating element ports 408 are inserted substantially perpendicular to both the direction of elongation in the heating device casing 403 and the general direction of heat transfer fluid flow. This perpendicular placement allows the heating element ports 408 to be withdrawn from the device when convenient, such as for repairs or according to the level of thermal input desired. Furthermore, the use of multiple heating element ports 408 allows the thermal storage bodies to be thermally charged in even and efficient manner.

Referring to the FIG. 7*c*, the horizontal rows of MGA blocks 401 forming one of the thermal storage bodies 402 are each positioned in a horizontally staggered manner, such that heat transfer channels are defined between the offset faces of the hexahedral MGA blocks 401 forming at least three rows. The offset positions of the MGA blocks in each row are secured by a combination of "T"-shaped spacers 410 and horizontal bar spacers 411, each placed between said blocks in a horizontally alternating manner. Preferably, filler blocks 412 are placed on the ends of every second row to support the weight of the MGA blocks 401 on the edge of every other row, stabilising the thermal storage body 402. The filler blocks 412 can be smaller blocks formed from MGA material, or they can be made of any material to provide rigidity to the overall array of blocks.

Depending on the scale of the energy storage device, access to the internal volume is provided by access ports. In the example illustrated in FIG. 7*d*, multiple doors 413 are provided for human access to the internal volume of the device, and thus the thermal storage bodies and the MGA blocks forming thereof. Moreover, the hexahedral MGA blocks 401 are arranged such that a heat transfer channel for a radiant heating element via port 408 is provided between said MGA blocks. Preferably, the MGA blocks are offset in pairs of two blocks to generate this heat transfer channel for heating element placement.

Figure 7E:
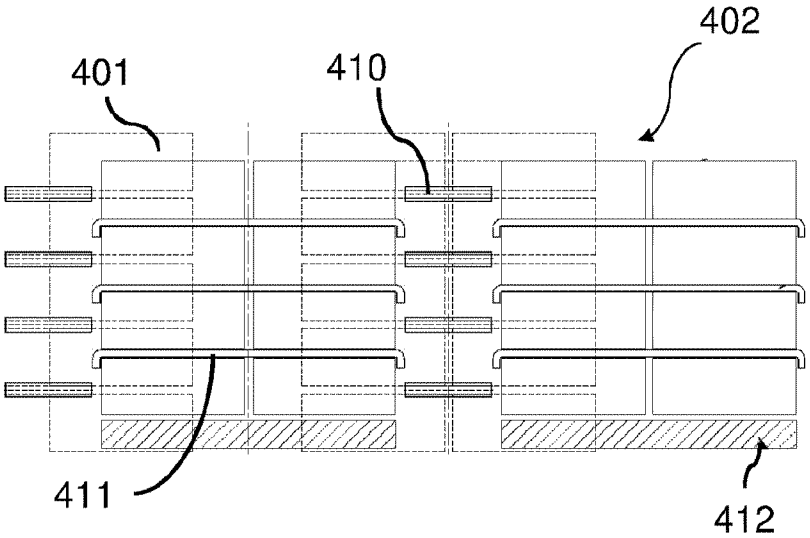
FIG. 7*e* is a close-up plan view of one of the thermal storage bodies, showing an arrangement of thermal storage block secured together using spacers.
Figure 7D:
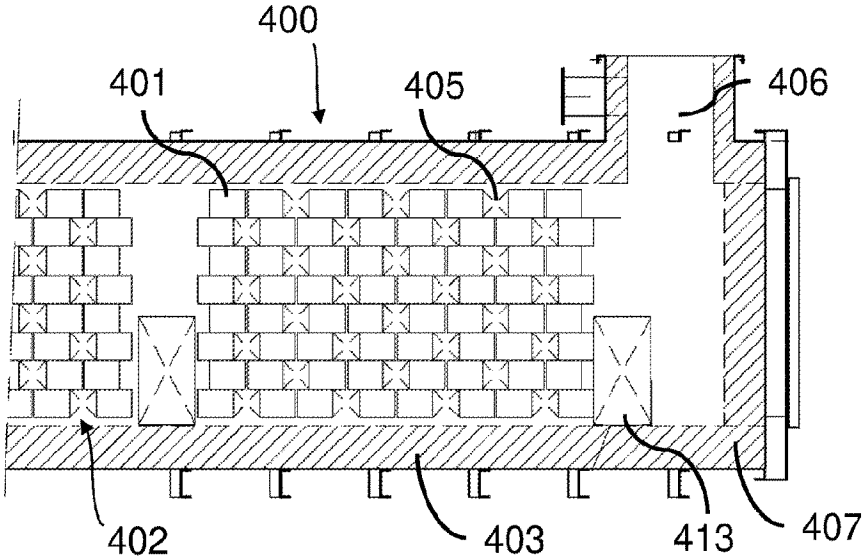
FIG. 7*d* is a truncated side section view of the energy storage device, showing multiple access ports in the form of doors.
Figure 7F:
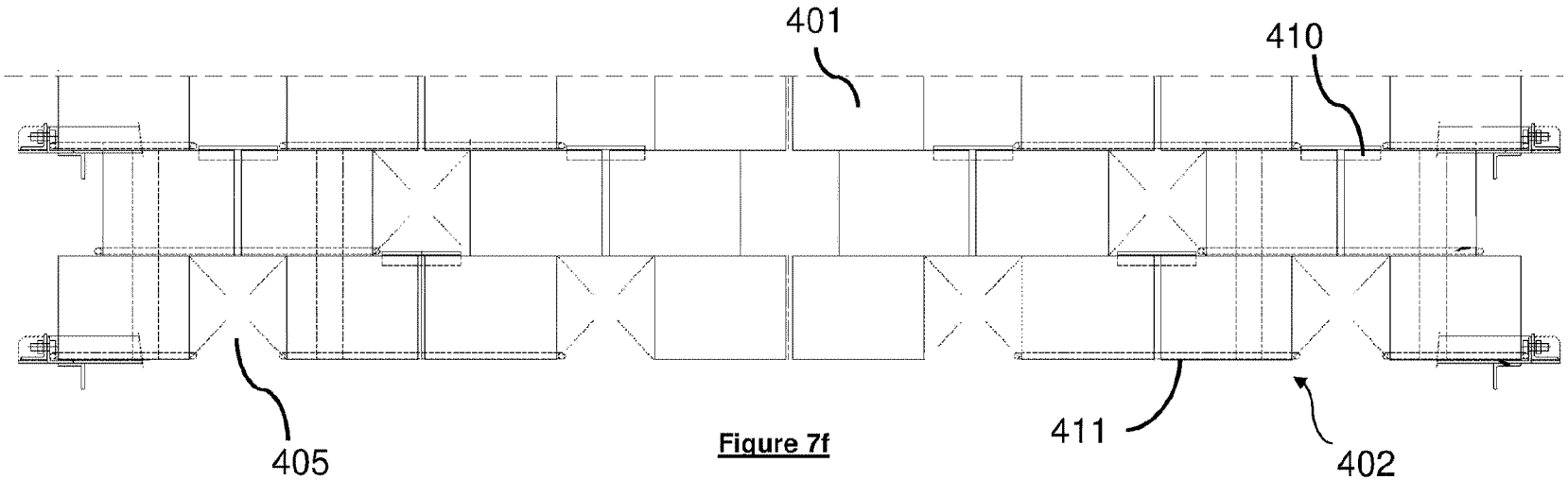
FIG. 7*f* is a close-up side view of the thermal storage body of FIG. 7*e*, showing the use of two different spacer types to secure said blocks.

A closer side elevation view of one thermal storage body in FIG. 7*e* and a plan view provided in FIG. 7*f* show that horizontal bar spacers of two differing lengths are provided to secure said MGA blocks 401 in the thermal storage body 402. In this regard, both figures illustrate that a longer, "B1"-type bar spacer is placed across the length of the pair of hexahedral MGA blocks, while a second shorter, "B2"-type bar spacer is adapted and used to secure single MGA blocks at the edges of the body 402 to allow for said staggered rows and the generation of heat transfer channels 405.

The three types of spacers-"T"-shaped, "B1" and "B2" bar spacers, together generate heat transfer channels in the form of longitudinal interstitial spaces and latitudinal heating element spaces, while also securing the MGA blocks for structural rigidity. Moreover, the combination of the bars prevent unnecessary strain of the MGA blocks that constitute the thermal storage body, such that they substantially alleviate thermal ratchetting.

The invention claimed is:

1. An energy storage device comprising:

at least one heating device;

a thermal storage body comprising a plurality of thermal storage blocks arranged in direct contact to form an integrated structure having an exterior and an interior and at least one heat transfer channel extending within the interior of the integrated structure formed by the thermal storage blocks inside of the thermal storage body, wherein the plurality of thermal storage blocks are formed from a miscibility gap alloy, wherein the at least one heat transfer channel is adapted to receive heat transfer fluid flow and/or the at least one heating device;

thermal insulation surrounding the thermal storage body such that the thermal storage body is substantially thermally insulated; and at least one substantially impermeable shell surrounding the thermal storage body and/or the thermal insulation such that the heat transfer fluid is substantially contained, wherein heat can be charged or discharged from the thermal storage body by thermal transfer between the at least one heat transfer channel and the plurality of thermal storage blocks.

2. The energy storage device according to claim 1 wherein the miscibility gap alloy comprises (i) a continuous thermally conductive matrix of a first component; and (ii) particles of a second component dispersed throughout the matrix of the first component;

wherein the first and second components are thermally stable wholly or partly immiscible in solid form and wherein the first component melts at a higher temperature than the second component; and wherein the first component contains and confines the second component at all times, including when the second component is in a molten or flowable state; and wherein the first and second components are independently metallic or non-metallic; and wherein the particles of the second component are microparticles.

3. The energy storage device according to claim 1, wherein the heat transfer fluid is in thermal contact with the plurality of thermal storage blocks when flowing through the at least one thermal transfer channel.

4. The energy storage device according to claim 3, wherein the heat transfer fluid is in direct contact with the plurality of thermal storage blocks.

5. The energy storage device according to claim 3, wherein the heat transfer fluid is in thermal contact with the plurality of thermal storage blocks when flowing through at least one heat exchanger pipe received by the at least one thermal transfer channel.

6. The energy storage device according to claim 1, wherein the at least one heating device is one or more electrically-driven radiant heaters.

7. The energy storage device according to claim 1, wherein the thermal energy transferred to the heat transfer fluid is used to power and/or heat an additional process operation.

8. The energy storage device according to claim 7, wherein the additional process operation is selected from a group consisting of a turbine, a Rankine cycle turbine-generator, a Barton cycle engine, a Stirling cycle engine, a Brayton cycle turbine-generator, a heat exchanger, a steam generator or a combination thereof.

9. The energy storage device according to claim 1, wherein the at least one heating device is adapted to charge the thermal storage body with additional heat while the thermal storage body is simultaneously discharging stored heat.

10. The energy storage device according to claim 1, wherein the second component microparticles comprising the miscibility gap alloy forming the at least one thermal storage block melts during charging of heat to the thermal storage body and remains molten until both sensible and latent heat is discharged therefrom.

11. A method for storing energy comprising the steps:

a) thermally charging a thermal storage body comprising a plurality of thermal storage blocks arranged in direct contact to form an integrated structure having an exterior and an interior and at least one heat transfer channel extending within the interior of the integrated structure formed by the thermal storage blocks inside of the thermal storage body, wherein the plurality of thermal storage blocks are formed from a miscibility gap alloy, by heating at least one heating device adjacent to one or more of the plurality of thermal storage blocks;

b) storing the thermal energy in the plurality of thermal storage blocks by substantially insulating and sealing the thermal storage body comprised therefrom, from the outside atmosphere; and c) thermally discharging heat from the thermal storage body by flowing a heat transfer fluid of a lower temperature in the at least one heat transfer channel such that heat is removed from the at least one thermal transfer block.

12. The method according to claim 11, wherein the plurality of thermal storage blocks is formed from a miscibility gap alloy which comprises:

(i) a continuous thermally conductive matrix of a first component;

(ii) particles of a second component dispersed throughout the matrix of the first component;

wherein the first and second components are thermally stable wholly or partly immiscible in solid form and wherein the first component melts at a higher temperature than the second component; and wherein the first component contains and confines the second component at all times, including when the second component is in a molten or flowable state; and wherein the first and second components can be independently metallic or non-metallic; and wherein the particles of the second component are microparticles.

13. The method according to claim 12, wherein the charged heat melts the microparticles of the second component of the miscibility gap alloy forming the plurality of thermal storage blocks during step a), such that both sensible and latent heat is stored in the thermal storage body during step b).

14. The method according to claim 11, wherein the thermal charging of step a) is performed by heating at least one heat exchanger coil and/or at least one electrically-driven radiant heater.

15. The method according to claim 14, wherein the at least one heat exchanger coil is heated by flowing the heat transfer fluid at a higher temperature than the plurality of thermal storage blocks such that heat is transferred thereto.

16. The method according to claim 11, wherein the charging and discharging of steps a) and c) respectively, occur at the same time.

17. A system for storing energy comprising the following unit operations:

at least one energy source;

at least one energy storage device comprising: at least one heating device; a thermal storage body comprising a plurality of thermal storage blocks arranged in direct contact to form an integrated structure having an exterior and an interior and at least one heat transfer channel extending within the interior of the integrated structure formed by the thermal storage blocks inside of the thermal storage body, wherein the plurality of thermal storage blocks are formed from a miscibility gap alloy, wherein the at least one heat transfer channel is adapted to receive heat transfer fluid flow and/or the at least one heating device; thermal insulation surrounding the thermal storage body such that the thermal storage body is substantially thermally insulated; and at least one substantially impermeable shell surrounding the thermal storage body and/or the thermal insulation such that the heat transfer fluid is substantially contained, wherein heat can be charged or discharged from the thermal storage body by thermal transfer between the at least one heat transfer channel and the plurality of thermal storage blocks;

at least one pumping means; and at least one heat transfer and/or energy conversion means, wherein the unit operations are in fluid communication with each other such that the system forms at least one fluid pass for transferring thermal energy therebetween.

18. The system according to claim 17, wherein the plurality of thermal storage blocks is formed from a miscibility gap alloy which comprises:

(i) a continuous thermally conductive matrix of a first component;

(ii) particles of a second component dispersed throughout the matrix of the first component;

wherein the first and second components are thermally stable wholly or partly immiscible in solid form and wherein the first component melts at a higher temperature than the second component; and wherein the first component contains and confines the second component at all times, including when the second component is in a molten or flowable state; and wherein the first and second components can be independently metallic or non-metallic; and wherein the particles of the second component are microparticles.

19. The system according to claim 17, wherein the energy source is an electrical and/or a thermal energy source.

20. The system according to claim 17, wherein the energy conversion means is selected from a group consisting of a turbine, a Rankine cycle turbine-generator, a Barton cycle engine, a Stirling cycle engine, a Brayton cycle turbine-generator, a steam generator or a combination thereof.

21. The system according to claim 17, wherein the at least one heat exchanging means is a heat exchanger for transferring thermal energy from the hot heat transfer fluid discharged from the at least one energy storage device to at least another heat transfer fluid or a working fluid in a multi-pass system.

22. The system according to claim 19, wherein the energy source is a renewable energy source.

* * * * *